United States Patent [19]

Azzato

[11] Patent Number: 4,652,013

[45] Date of Patent: Mar. 24, 1987

[54] BOOK HANGER HARDWARE

[75] Inventor: Robert N. Azzato, Phoenix, Ariz.

[73] Assignee: General Binding Corporation, Northbrook, Ill.

[21] Appl. No.: 817,539

[22] Filed: Jan. 10, 1986

[51] Int. Cl.[4] ..... B42D 1/06; B42F 15/00; B41J 11/00

[52] U.S. Cl. ..... 281/46; 402/77; 248/442.2

[58] Field of Search ..... 281/20, 46, 15 A; 402/76, 77; 248/441.1, 441.2

[56] References Cited

U.S. PATENT DOCUMENTS

| | | | |
|---|---|---|---|
| 412,221 | 10/1889 | Allen | 248/442.2 |
| 1,078,354 | 11/1913 | Jensen | 281/46 |
| 1,187,420 | 6/1916 | Edwards | 281/46 |
| 1,219,777 | 3/1917 | Ridall | 281/46 |
| 1,559,971 | 11/1925 | Meyer | 281/46 |
| 1,826,627 | 10/1931 | Meyerson | 281/46 |

*Primary Examiner*—Paul A. Bell
*Assistant Examiner*—Paul M. Heyrana, Sr.

[57] ABSTRACT

There is disclosed herein hardware for securing and supporting a telephone directory or the like within a protective cover. The hardware includes a support assembly to be secured to the protective cover and for supporting the directory. The assembly includes an elongated backing support having spaced first and second supports. Each support includes an upstanding flange which carries inwardly-extending, book-engaging tines. Each of the tines includes an inner shaped or curved end and has rounded edges, at least along the inner end. In one embodiment one support is integral with the backing support and the other is removably secured thereto.

9 Claims, 6 Drawing Figures

FIG. 1
FIG. 2
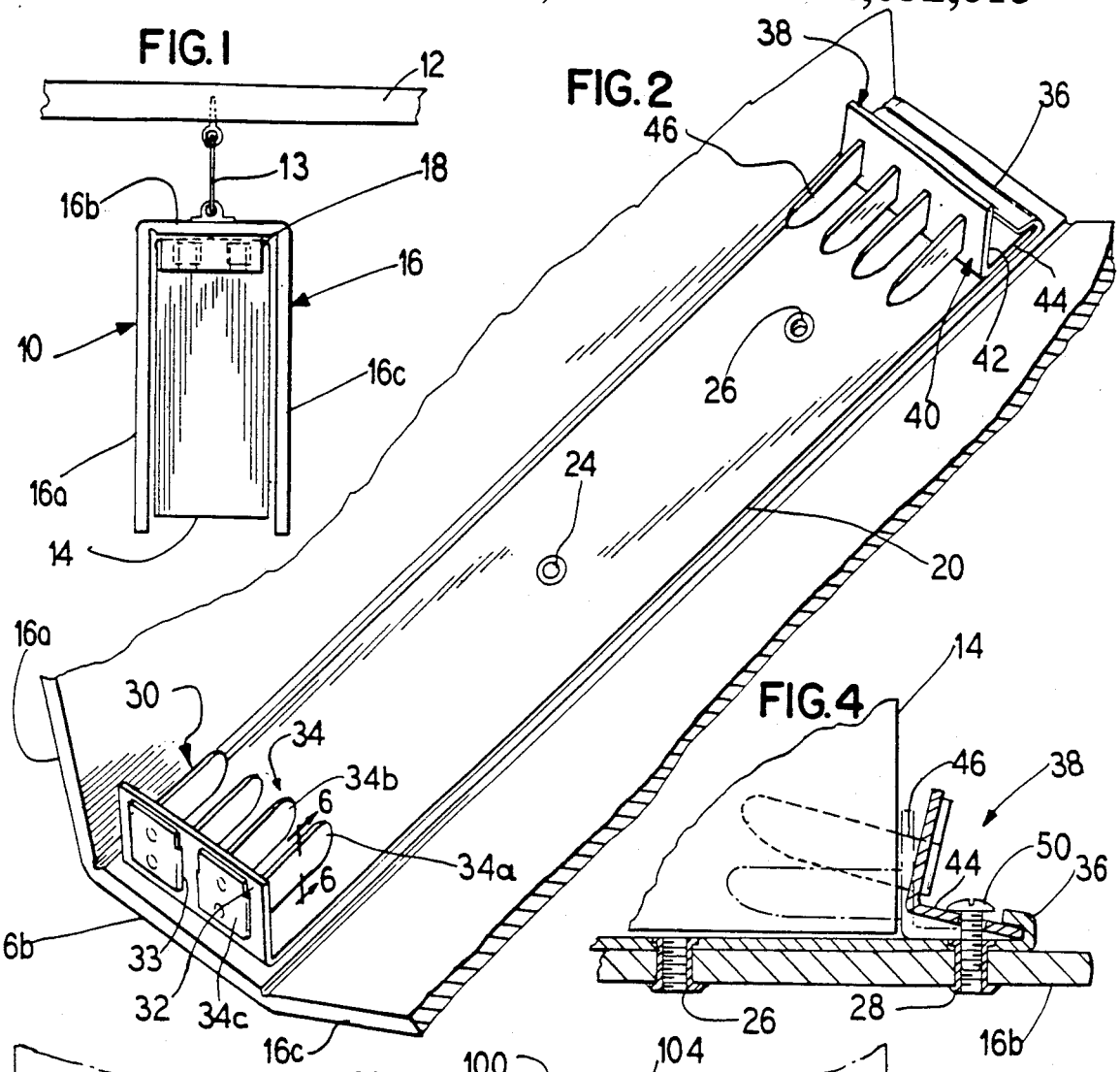
FIG. 4
FIG. 3
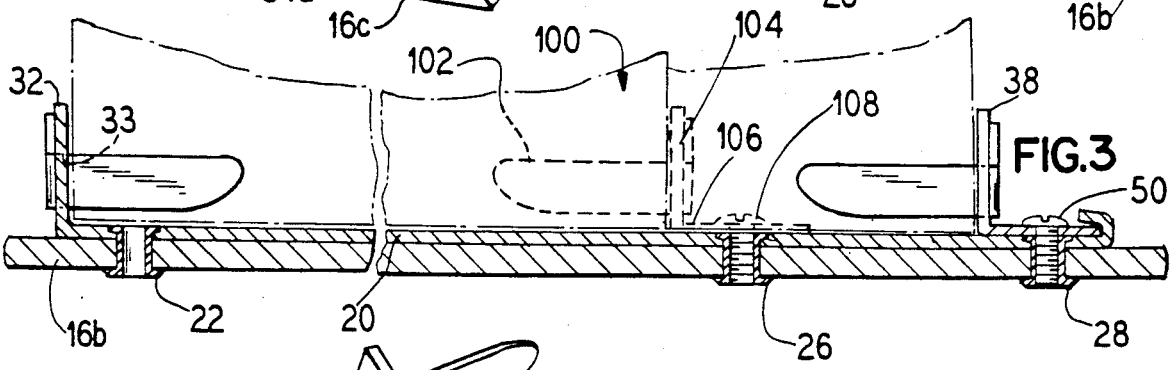
FIG. 5
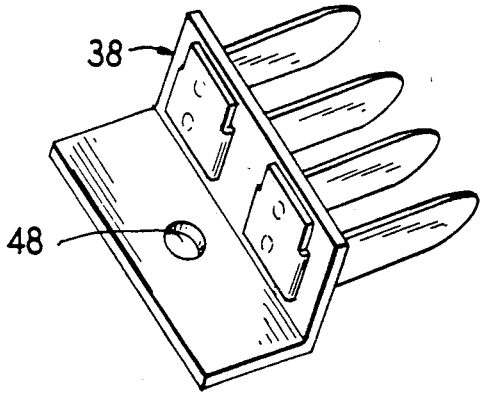
FIG. 6
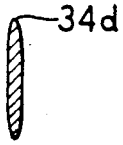

BOOK HANGER HARDWARE

BACKGROUND OF THE INVENTION

This invention relates to binders for protecting books and, more particularly, relates to the hardware for binding a telephone directory or the like within a protective cover and for hanging a bound directory in a telephone booth.

Telephone directories are provided for use in public telephone booths. In order to minimize pilferage and protect the directories from the environment, they have been bound in a protective cover which is, in turn, secured to the booth. Such protected directories have been secured by hanging the directory from a chain or hinge associated with a shelf in the booth. In both situations, the binder is provided with support hardware for securing the directory to the protective cover and supporting the hanging directory.

See U.S. Pat. Nos. 3,705,706 and 4,152,013 for examples of such systems and hardware.

One system, such as that in U.S. Pat. No. 3,705,706, includes a backing support member for securement to the cover and a wire-like member secured at its ends to supports provided at the ends of the backing support member. The directory is mounted by positioning the directory back on the backing support member, opening the directory, and placing the wire at the center of the directory between the pages thereof so as to hold the backing between the support member and wire. Thus when hung, the directory hangs from or is supported by the wire.

It is desirable to decrease the possibility of book breakage from the wire and reduce any looseness of the book in its binding.

It is also desirable to provide an improved book support hardware for binding various type of books, such as telephone directories, in a protective cover.

Furthermore, it is desirable to provide hardware for directories of different lengths, such as nine inches and eleven inches.

It is the object of this invention to provide support hardware which fulfills these desires.

These and other objects of this invention will become apparent from the following description and appended claims.

SUMMARY OF THE INVENTION

There is provided by this invention support hardware for binding a book in a protective cover which provides support at the ends of the book and can be used with books of different lengths.

The hardware includes a support assembly for supporting the book or directory in the cover. The assembly includes a backing support member or plate for securing the support assembly to the cover. The backing support member has a first support means at one end and a second support means at the other end. Each of the support means has an upstanding flange extending from the backing support and inwardly-extending, book-engaging tines spaced from the backing support member and extending inwardly along the backing support member toward each other. The ends of the tines are curved or shaped and at least the edges at each end are rounded for easy insertion between the pages of the book or directory to be protected.

Preferably, the first support means is integral with the backing support and the second support means is removably secured to the backing support. In order to accommodate books of different lengths, a plurality of securement points are provided along the length of the backing support a which the removable second support means can be selectively secured.

The end of the backing support adjacent the removable support is shaped for engagement therewith so that forces applied to the support means are transferred to the backing support.

BRIEF DESCRIPTION OF THE DRAWINGS

FIG. 1 is an elevational view showing a bound directory in a hanging position;

FIG. 2 is a perspective view of the book support hardware secured to a protective cover;

FIG. 3 is a sectional view showing a directory supported on the backing support with the support means and, showing in broken lines, a second removable support means for use with a shorter book;

FIG. 4 is a fragmentary sectional view showing the manner of connecting the removable support means to the backing support and a directory end;

FIG. 5 is a perspective view of a removable support means; and

FIG. 6 is a sectional view taken along line 6—6 of FIG. 2 showing the rounded edges of a tine.

DESCRIPTION OF THE PREFERRED EMBODIMENT

Referring now to the drawings, a bound directory 10 generally is shown hanging from a shelf 12 by a hanger 13. The bound directory includes the directory 14, the protective cover 16 and a support hardware 18. The protective cover includes a front cover **16*a*, spine 16*b*, and back cover 16*c***, which are hingedly connected at the corners.

The support hardware 18 includes a backing support member or plate 20, which is secured to the spine **16*b* by hollow rivets, such as 22, 24, 26 and 28, which may be internally threaded. The support member 20 extends for substantially the entire length of the spine, but its ends are spaced inwardly from the ends of the spine. A first book-engaging support 30** is provided at one end of the backing support member and is preferably integral therewith.

The first support includes an upstanding flange 32 having four tine-receiving slots, such as 33, extending therethrough. Four inwardly-extending tines for cooperation with slots, such as 33, are provided by two U-shaped members, such as 34, each having a pair of tines **34*a* and 34*b* and a bight portion 34*c* that extends above or beyond the height of the tine. The bight portion 34*c* is spot welded to the flange 32. Each of the tines, such as 34*a*, is shaped or curved at its end and has rounded edges, such as 34*d*, seen in FIG. 6**. The curved shape and rounded edges permit the tines to easily slip between the pages of the directory. The rounded edges may be formed in a coining or tumbling operation during manufacture.

The other end of the support member 20 is curled or reverse bent so as to form an inwardly-opening, U-shaped, channel-like force-transmitting section 36. The second book-engaging support 38 is removable and constructed to engage the inwardly-opening section 36 so as to transfer forces applied to the support through the section 36, to the backing support 20. The support 38 includes an L-shaped, bracket-like member 40 having an upstanding leg or book-engaging flange 42 and an outwardly extending securement leg 44. The securement leg 44 is of a length effective to permit its outer edge to fit within and engage the section 36. Book-engaging tines 46, like those at the first end, extend through the flange 42 and extend inwardly therefrom. As seen in FIG. 5, a mounting hole 48 is provided in the leg 44 for use in securing the support 38 to the support member 20.

Referring now to FIG. 4, the second support 38 is shown being mounted to the backing support 20 with a directory 14 in place. The outwardly-extending leg 44 is positioned in the channel 36 and the tines 46 fit between the pages of the directory 14. The screw 50 is passed through the hole 48 in leg 44 and into the threaded rivet 28. As the screw is tightened, it draws the leg 44 toward the back support 20 into force-transmitting engagement with channel 36 and the tines 46 adjacent the directory 14.

The removable support 38 is positioned adjacent the directory so as to retain it in place. The dimensions of the backing support, securement positions, and first and second supports are preferably selected so that the distance between the supports approximates the length of the directory, thus securing the directory in place.

Forces resulting from shifting or movement of the book are transmitted through support 30 to the backing member 20, or through support 38, to the channel section 36, and thus to the backing member 20. This arrangement reduces the lateral forces acting on the screws or fasteners, such as 50, and reduces the risk of loosening the fasteners, and thus the directory.

In order to accommodate directories of different lengths, a plurality of spaced securement points are provided along the length of the backing support. In the embodiment illustrated, the securement points are the internally threaded rivets, such as 26 and 28.

Since the distance between the various securement points 26, 28, and the force-transmitting channel 36 varies, several removable supports are required to accommodate the differences. The supports are substantially the same, except that the securement legs are of different lengths. In FIG. 3, the bracket 100 has book-engaging tines, such as 102, on the tine-carrying flange 104 and a securement leg 106. The outward end of leg 106 engages the force-transmitting section 36 and is held in place by screw 108. Thus it is seen that leg 106 is longer than leg 44, but serves the same purpose for shorter directories. Bracket 100 mounts to the backing support and secures the directory in the same manner as support 38. Of course, the leg 106 may be of any length to accommodate specifically sized directories, or the like. The embodiments described are standards and most commonly found.

It will be seen by those skilled in the art that the typical directory is quite accurately sized and will be securely positioned by the present binding. This invention minimizes tearing of the directory back from impacts due to dropping the book, and simplifies the assembly installation, all with an inexpensive, yet very strong, construction.

Although the invention has been described with respect to preferred embodiments, it is not to be so limited as changes and modifications can be made which are within the full intended scope of the invention as defined by the appended claims.

I claim as my invention:

1. An assembly for supporting a book in a protective cover, said assembly including a backing support member having a first support means at one end thereof and a second support means at the other end thereof, each of said support means including upstanding flange means, and inwardly projecting book-engaging tines mounted on said upstanding flange means and projecting inwardly toward each other, for engaging a book between its pages and adjacent its binding, each of said tines having a shaped inner end and rounded edges so as to fit, at least along the inner end, between the pages of a book and cooperate in securing the book between the support members, wherein said first support means is integral with said backing member and said second support means is removably attached to said backing member, and said backing member having at the other end thereof a transverse, U-shaped section for engaging said second support means.

2. An assembly as in claim 1, wherein each of said tine ends is curved.

3. An assembly as in claim 1, wherein said second support means includes an L-shaped member with one leg forming the upstanding tine-carrying flange and the other leg extending outwardly along the backing member and the end of said leg being secured in and engaging said U-shaped section on said backing member.

4. An assembly as in claim 3, wherein threaded fastener means are provided for securing said second support means to said backing member.

5. An assembly as in claim 3, wherein means are provided for threadably fastening said second support means to said backing member at plurality of locations spaced inwardly from said other end, and the other leg of said second support means being of a length effective to engage said U-shaped section.

6. An assembly as in claim 5, wherein there is provided for selective use a short second support means for use with said fastening means adjacent said other end and a long second support means for use with a second fastening means, which is spaced inwardly from the other end and first fastening means, and has an other leg of a length effective to engage said U-shaped end and longer than the other leg of the short support means.

7. A hanger assembly as in claim 1, wherein the tines extend along and adjacent the backing support member.

8. An assembly as in claim 1, wherein said second support means transfers forces applied thereto through said U-shaped section to said backing member.

9. An assembly for supporting a book in a binder, said binder having a spine member and a pair of cover members, each hingedly connected to said spine member, said hanger assembly secured to the inner surface of said spine member between said cover members and said assembly including a backing member secured to said spine member, and having a first support means at one end of said backing member and integral therewith an open reverse bent channel-like section formed at the other end and a plurality of fastening points longitudinally spaced from said other end, and a second support means adapted for removable securement to a selected fastening point, each of said support means having an upstanding flange extending from said backing support member and inwardly-extending book-engaging tines, said second support member having an L shape with one leg being the upstanding tine-carrying flange and the other leg extending outwardly and adapted to engage said channel-like section, each of said tines having a shaped inner end and rounded edges at least along the inner end so as to fit between the pages of a book and of a length effective to engage the open reverse bent end of said backing support for transferring force from the tines and flanges of the second support means to the backing support, and said first and second support means being spaced from each other a distance effective to secure a book therebetween.

* * * * *